United States Patent [19]

Nolan

[11] 4,107,577

[45] * Aug. 15, 1978

[54] TRANSFER WITHIN GASEOUS DISCHARGE DISPLAY/MEMORY DEVICE

[75] Inventor: James F. Nolan, Sylvania, Ohio

[73] Assignee: Owens-Illinois, Inc., Toledo, Ohio

[ * ] Notice: The portion of the term of this patent subsequent to Apr. 9, 1991, has been disclaimed.

[21] Appl. No.: 729,447

[22] Filed: Oct. 4, 1976

Related U.S. Application Data

[63] Continuation of Ser. No. 445,921, Feb. 26, 1974, abandoned, which is a continuation of Ser. No. 103,848, Jan. 4, 1971, Pat. No. 3,803,448.

[51] Int. Cl.[2] ..... H05B 41/14

[52] U.S. Cl. ..... 315/169 TV; 340/324 M

[58] Field of Search ..... 315/169 R, 169 TV; 340/324 M

[56] References Cited

U.S. PATENT DOCUMENTS

| | | | |
|---|---|---|---|
| 3,334,269 | 8/1967 | L'Heureux | 315/58 |
| 3,499,167 | 3/1970 | Baker et al. | 315/169 TV |
| 3,719,940 | 3/1973 | Lay et al. | 315/169 TV X |
| 3,803,448 | 4/1974 | Nolan | 315/169 R |
| 3,868,543 | 2/1975 | Holz et al. | 315/169 TV |

*Primary Examiner*—Eugene R. LaRoche

*Attorney, Agent, or Firm*—Donald K. Wedding; Myron E. Click; David H. Wilson

[57] ABSTRACT

There is disclosed the transfer of a gaseous discharge within a display/memory device. There is particularly disclosed a method for conditioning a multiple gaseous discharge display/memory device having an electrical memory and capable of producing a visual display, the device being characterized by an ionizable gaseous medium in a gas chamber formed by a pair of opposed dielectric material charge storage members which are respectively backed by a series of parallel-like conductor (electrode) members, the conductor members behind each dielectric material member being transversely oriented with respect to the conductor members behind the opposing dielectric material member so as to define a plurality of discrete discharge volumes, each of which constitutes a discharge unit. The conditioning of the device comprises the combined use of a pilot unit and a pre-address voltage signal so as to supply free electrons to each discrete volume or unit in order that a discharge can be initiated when such conditioned unit is addressed.

1 Claim, 3 Drawing Figures

TRANSFER WITHIN GASEOUS DISCHARGE DISPLAY/MEMORY DEVICE

RELATED APPLICATION

Figure 1:
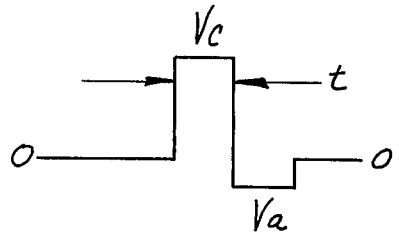

This is a continuation of application Ser. No. 445,921, filed Feb. 26, 1974, now abandoned which in turn is a continuation of U.S. Pat. Application Ser. No. 103,848, filed Jan. 4, 1971, now U.S. Pat. No. 3,803,448, the benefit of which is claimed under 35 U.S.C. 120.

THE INVENTION

This invention relates to multiple gas dicharge display/ memory devices which have an electrical memory and which are capable of producing a visual display including the representation of data such as numerals, letters, television display, radar displays, binary words, etc.

Multiple gas discharge display and/or memory devices of the type with which the present invention is concerned are characterized by an ionizable gaseous medium, usually a mixture of at least two gases at an appropriate gas pressure, in a thin gas chamber or space between a pair of opposed dielectric charge storage members which are backed by conductor (electrode) members, the conductor members backing each dielectric member being transversely oriented to define a plurality of discrete discharge volumes, each of which constitutes a discharge unit. In some prior art devices, the discharge units are additionally defined by surrounding or confining physical structure such as by cells or apertures in perforated glass plates and the like so as to be physically isolated relative to other units. In either case, with or without the confining physical structure, charges (electrons, ions) produced upon ionization of the gas of a selected discharge unit, when proper alternating operating potentials are applied to selected conductors thereof, are collected upon the surfaces of the dielectric at specifically defined locations and constitute an electrical field opposing the electrical field which created them so as to terminate the discharge for the remainder of the half cycle and aid in the initiation of a discharge on a succeeding opposite half cycle of applied voltage, such charges as are stored constituting an electrical memory.

Thus, the dielectric layers prevent the passage of any conductive current from the conductor members to the gaseous medium and also serve as collecting surfaces for ionized gaseous medium charges (electrons, ions) during the alternate half cycles of the A.C. operating potentials, such charges collecting first on one elemental or discrete dielectric surface area and then on an opposing elemental or discrete dielectric surface area on alternate half cycles to constitute an electrical memory.

An example of a panel structure containing nonphysically isolated or open discharge units is disclosed in U.S. Letters Pat. No. 3,499,167 issued to Theodore C. Baker, et al.

An example of a panel containing physically isolated units is disclosed in British patent specifications Nos. 1,161,832 and 1,161,833 and also in the article by D. L. Bitzer and H. G. Slottow entitled "The Plasma Display Panel - A Digitally Addressable Display With Inherent Memory", Proceeding of the Fall Joint Computer Conference, IEEE, San Francisco, California, Nov. 1966, pages 541–547.

In the operation of the panel, a continuous volume of ionizable gas is confined between a pair of dielectric surfaces backed by conductor arrays forming matrix elements. The cross conductor arrays may be orthogonally related (but any other configuration of conductor arrays may be used) to define a plurality of opposed pairs of charge storage areas on the surfaces of the dielectric bounding or confining the gas. Thus, for a conductor matrix having H rows and C columns the number of elemental discharge volumes will be the product H × C and the number of elemental or discrete areas will be twice the number of elemental discharge volumes.

The gas may be one which produces light (if visual display is an objective) and a copious supply of charges (ions and electrons) during discharge. In an open cell Baker, et al. type panel, the gas pressure and the electric field are sufficient to laterally confine charges generated on discharge within elemental or discrete volumes of gas between opposed pairs of elemental or discrete dielectric areas within the perimeter of such areas, especially in a panel containing non-isolated units.

With respect to the memory function of a given discharge panel, the allowable distance or spacing between the dielectric surfaces depends, among other things, on the frequency of the alternating current supply, the distance typically being greater for lower frequencies.

While the prior art does disclose gaseous discharge devices having externally positioned electrodes for initiating a gaseous discharge, sometimes called "electrodeless discharges", such prior art devices utilize frequencies and spacings or discharge volumes and operating pressures such that although discharges are initiated in the gaseous medium, such discharges are ineffective or not utilized for charge generation and storage in the manner of the present invention.

The term "memory margin" is defined herein as $$M.\ M. = (V_f V_s / V_s)$$

wherein $V_f$ is the magnitude of the applied voltage at which a discharge is initiated in a discrete conditioned (as explained in the aforementioned Baker, et al. patent) volume of gas defined by common areas of overlapping conductors and $V_s$ is the magnitude of the minimum applied periodic alternating voltage sufficient to sustain discharges once initiated. It will be understood that basic electrical phenomena utilized in this invention is the generation of charges (ions and electrons) alternately storable at pairs of opposed or facing discrete points or areas on a pair of dielectric surfaces backed by conductors connected to a source of operating potential. Such stored charges result in an electrical field opposing the field produced by the applied potential that created them and hence operate to terminate ionization in the elemental gas volume between opposed or facing discrete points or areas of dielectric surface. The term "sustain a discharge" means producing a sequence of momentary discharges, one discharge for each half cycle of applied alternating sustaining voltage, once the elemental gas volume of the discharge unit has been fired, to maintain alternate storing of charges at pairs of opposed discrete areas on the dielectric surfaces. When a discharge unit is in such a state, it is said to be in the on state.

In the operation of a multiple gaseous discharge device, of the type described hereinbefore, it is necessary to condition the discrete elemental gas volume of each discharge unit by supplying at least one free electron thereto such that a gaseous discharge can be initiated when the unit is addressed with an operating voltage signal.

The prior art has disclosed and practiced various means for conditioning gaseous discharge units.

One such method comprises the use of external radiation, such as flooding part or all of the gaseous medium of the panel with ultraviolet radiation. This external conditioning method has the obvious disadvantage that it is not always convenient or possible to provide external radiation to a panel, especially if the panel is in a remote position. Likewise, an external UV source requires auxiliary equipment. Accordingly, the use of internal conditioning is generally preferred.

One internal conditioning means comprises using internal radiation, such as by the inclusion of a radioactive material and/or by the use of one or more so-called pilot discharge units for the generation of photons.

As described in the Baker, et al. patent, the space between the dielectric surfaces occupied by the gas is such as to permit photons generated on discharge in a selected discrete or elemental volume of gas (discharge unit) to pass freely through the panel gas space so as to condition other and more remote elemental volumes of other discharge units.

However, such internal photon generation and electron conditioning of the panel gaseous medium becomes unreliable when a given discharge unit to be addressed is remote in distance (an inch or more) relative to the conditioning source, e.g., the pilot unit. Thus, a multiplicity of pilot units or cells may be required for the conditioning of a panel having a large geometric area.

Another means of panel conditioning comprises a so-called electronic process whereby an electronic conditioning signal or pulse is periodically applied to all of the panel discharge units, as disclosed for example in British patent specification No. 1,161,832, page 8, lines 56 to 76. However, electronic conditioning is self-conditioning and is only effective after a discharge unit has been previously conditioned; that is, electronic conditioning involves periodically discharging a unit and is therefore a way of maintaining the presence of free electrons. Accordingly, one cannot wait too long between the periodically applied conditioning pulses since there must be at least one free electron present in order to discharge and condition a unit.

In accordance with the practice of this invention, there is provided an improved process of conditioning gaseous discharge panels, especially panels having a large geometric area.

More particularly, there is provided a process for rapidly and reliably conditioning a multiplicity of gaseous discharge units distributed over the relatively wide geometric area of a gas discharge device having at least one pilot unit in the on state, which process comprises selectively applying a preaddressing voltage signal to a series of connecting discharge units which are intermediate relative to at least one pilot unit and to each discharge unit to be addressed, said voltage being sufficient to propagate the gaseous medium conditioning from the pilot unit across the connecting intermediate units to each unit to be addressed.

The connecting, intermediate units do not necessarily have to be adjacent to each other or adjacent to the pilot unit or units to be addressed. Likewise, the units do not have to be arranged in a straight line. It is only essential that such intermediate units be geometrically arranged and positioned so that one unit photonically connects to another unit which photonically connects to another unit and so forth; that is, the intermediate units must photonically connect so as to pass the conditioning process from the pilot unit to the unit to be addressed. As a practical matter, the connecting units may be adjacent.

Figure 2:
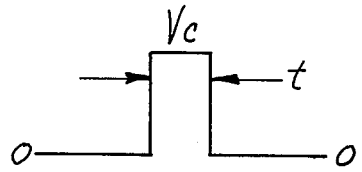
Figure 3:
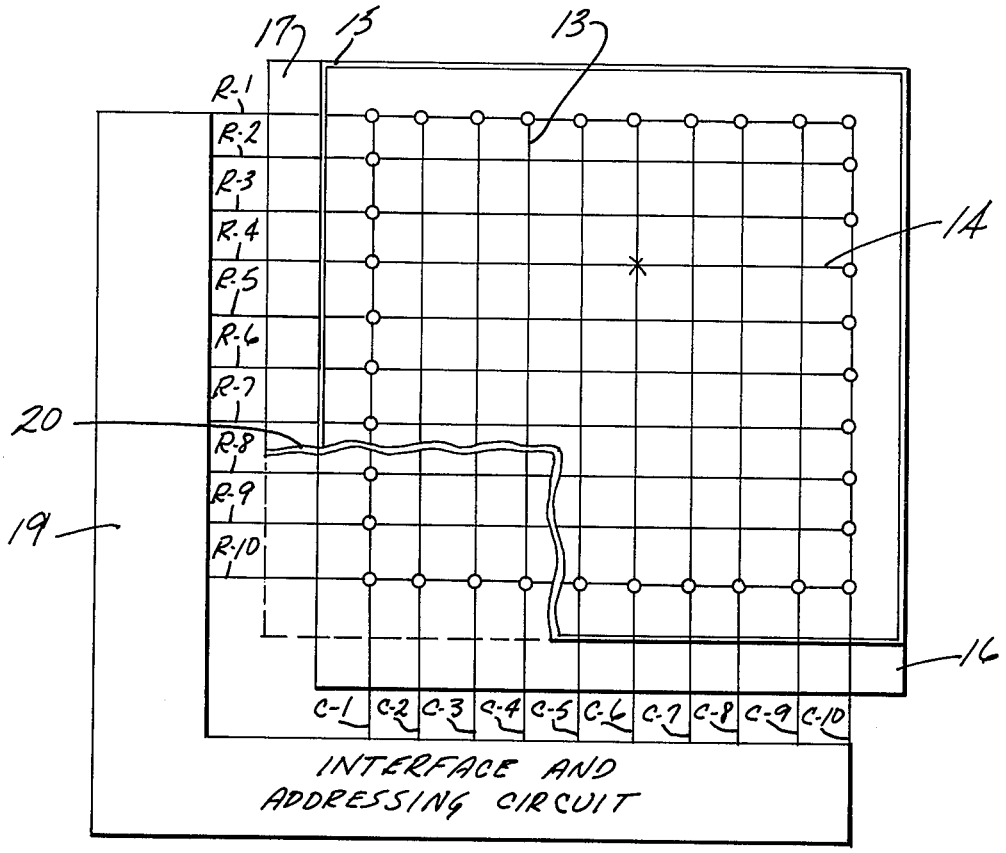

The features and advantages of the invention will be better understood by reference to the following detailed description when considered in connection with the accompanying drawings:

FIGS. 1 and 2 illustrate pre-addressing or conditioning voltage signals for a gas discharge display/memory panel; and FIG. 3 is a partially cut-away plan view of a gaseous discharge display/memory panel embodying the invention.

Referring to FIG. 3, a typical gaseous discharge display/memory panel such as is disclosed in Baker, et al. Pat. No. 3,499,167 is constituted by a pair of support plates 16 and 17, with a row conductor array 13 being on row plate 17 and a column conductor array 14 being on column plate 16. These conductor arrays 13 and 14 in the operating or viewing area of the panel have a thin dielectric coating applied thereto and the plates are joined in spaced-apart relation by a spacer sealant member 15. An ionizable gaseous discharge medium which is typically a mixture of two gases such as neon and nitrogen at a selected pressure is confined in the thin chamber formed between the dielectric coatings.

The panel has an electrical memory constituted by the storage of charges produced by discharge on the surfaces of the dielectric in contact with the gas. Thus, the conductors are non-conductively coupled to the gaseous medium. As described above, the conductors in arrays 13 and 14 form a cross-conductor matrix wherein the discharge sites are arrayed in columns and rows, C-1 to C-10 and R-1 to R-10. The dielectric layers 20 prevent the passage of any conductive current from the matrix conductor member to the gaseous medium and also serve as the collecting surfaces for discharges in the ionizable gaseous medium during alternate half cycles of the periodic operating potentials applied thereto.

An interface and addressing circuit or system 19 transmits a sustainer voltage, a firing voltage, and a conditioning signal or pulse to each of the row and column conductors 13 and 14 as required.

Each of the FIGS. 1 and 2 illustrates a pre-addressing or conditioning voltage signal Vc or a square or rectangular waveform having a time or pulse width *t*. The voltage signal is initiated from and returned to an initial state O. In FIG. 1, there is further illustrated an adjusting voltage $V_a$ for more conveniently returning the signal to the initial state O.

Although the square or rectangular waveform of FIGS. 1 and 2 is preferred, any other suitable waveform or geometric shape may be used providing the time or pulse width *t* is sufficient to allow all of the intermediate connecting discharge units to fire. Although the same signal is applied simultaneously to all of the intermediate discharge units, each fires at a different, but sequential, time; that is, at a different point or position on the voltage signal curve. It is therefore essential that the overall time *t* (pulse width) be sufficient to allow each (and all) of these units to independently discharge and provide a free electron to the next unit and so on until the to-be-addressed unit has been conditioned.

In the specific practice hereof, the magnitude of the conditioning voltage must be sufficient to fire or discharge the discharge unit. However, if the voltage signal is applied to an operating discharge unit in the on state, the magnitude must not be great enough to interfere with or interrupt the operation of such unit; also the polarity of the signal Vc must be the same as the polarity of the preceding sustaining voltage half cycle applied to the on unit.

As noted hereinbefore, it has been found in the past that one method of conditioning a panel (i.e., providing initiating electrons to insure that an addressed site will turn on) is to light one or more pilot cells in the panel. One problem with this method of conditioning is that turn on becomes unreliable when the addressed site is some distance away (an inch or so) from the pilot cell. Thus, it has not been practical to use only a relatively small number of pilot cells (e.g., one) for large panels. This invention surmounts this difficulty by changing the method of addressing or writing somewhat, and making use of the fact that the conditioning process can be propagated across a panel at high speeds. More especially, this invention makes use of the fact that the conditioning process can be propagated across a panel at a speed of more than 2 inches/ microsecond, thus allowing a pilot cell to condition a remote site reliably provided that the conditioning process is propagated across a number of intermediate sites.

One specific practice of this invention proposes to apply a voltage signal as shown in FIGS. 1 and 2 to every cell of a panel immediately prior to addressing or writing at any site. Such a signal in FIGS. 1 or 2 causes two short duration discharges to occur at every site in the off state and does not cause any discharges at sites in the on state.

Referring again to FIG. 3, the border discharge units or cells, designated with an "O", along row conductors R-1 and R-10 and along column conductors C-1 and C-10 are normally maintained in the ON condition. These border units, as described in Baker, et al. will be designated hereinafter as "pilot cells".

Under normal addressing schemes, the pilot cells are too far away from remote addressed sites to insure reliable turn-on. This invention proposes to reliably turn on any site in the panel by applying a pre-address or pre-write signal, e.g., as shown in FIGS. 1 or 2, to all or a portion of the cell sites in the panel followed by the turn-on signal to the addressed site only. More specifically, for example, it may be desired to address the site R-4, C-6, designed with an "X". Although the pilot cell R-10, C-6 is too far away from the addressed site R-4, C-6, to reliably condition it, a pre-addressed signal applied between electrode C-6 and electrodes R-9, 8, 7, 6 and 5 can reliably condition the sites R-9, C-6; R-8, C-6; R-7, C-6; R-6, C-6; and R-5, C-6 nearer the pilot cell, causing them to discharge during the pre-write signal. Each of these cells in turn conditions its neighbor cell and the conditioning process is thus propagated along the panel to the addressed site R-1, C-6. Since the speed of propagation is approximately 2 inches per microsecond, the conditioning process may be propagated approximately 20 inches in a 10 microseconds pulse width or time duration for the prewrite signal shown in FIG. 1. If longer distances are required, the pulse width of the pre-write signal can be increased. It is, of course, possible to use more than one pilot cell and this may be desirable in some cases. However, it appears that one pilot cell, with a 20 microseconds pulse with pre-write signal, is sufficient to condition a 2 feet by 2 feet panel.

It should be noted that the pre-write signal does not have to be re-applied to the panel periodically to keep it in a conditioned state. For example, if a panel has every site off for a long time, (e.g., several hours), it would still require only one pre-write signal, immediately prior to the write signal, to insure reliable writing at any site, provided only that at least one pilot cell is on when the pre-write signal is applied. Also, if writing is done at a rapid rate, it is not necessary to precede every write signal with a pre-write signal. Nothing is usually gained by having successive pre-write signals occur at time intervals less than about 500 microseconds.

I claim:

1. In a process for operating a multiple gaseous discharge display/memory panel device comprising a multiplicity of alternating current operated gaseous discharge units, including discharge units at one side of said panel, the improvement wherein each discharge unit is in physically unconstrained open photonic communication with all of its adjacent discharge units and at least one discharge unit at the side of said panel has a discharge entered thereto and wherein said discharge at said at least one discharge unit at the side of the panel is electronically transferred and propagated laterally from one discharge unit to a first neighboring adjacent unit and from said first neighboring adjacent unit to one of its neighboring adjacent units remote from said at least one discharge unit at the side of said panel and so on across said panel to a selected discharge unit and terminating the transfer of said discharge at said selected unit.

* * * * *